US005136754A

United States Patent [19]

Kuroda

[11] Patent Number: 5,136,754

[45] Date of Patent: Aug. 11, 1992

[54] SPRING CLIP

[75] Inventor: Akitada Kuroda, Aichi, Japan

[73] Assignee: LEC Kabushiki Kaisha, Tokyo, Japan

[21] Appl. No.: 808,636

[22] Filed: Dec. 17, 1991

[30] Foreign Application Priority Data

Aug. 7, 1991 [JP] Japan ..... 3-197541

[51] Int. Cl.[5] ..... B42F 1/00

[52] U.S. Cl. ..... 24/67.9; 24/67.3; 24/67.11; 24/545

[58] Field of Search ..... 24/67.9, 67.11, 67.3, 24/67.5, 67.7, 545, 546, 563

[56] References Cited

U.S. PATENT DOCUMENTS 389,918 9/1888 Bennett ..... 24/563
606,718 7/1898 Hill ..... 24/67.3
2,729,868 1/1956 Manning ..... 24/545
3,348,272 10/1967 Germani ..... 24/563
4,706,342 11/1987 Yu ..... 24/67.9
4,991,269 2/1991 Kuroda ..... 24/545

FOREIGN PATENT DOCUMENTS 0019983 of 1914 United Kingdom ..... 24/67 R

*Primary Examiner*—Victor N. Sakran
*Attorney, Agent, or Firm*—Fleit, Jacobson, Cohn, Price, Holman & Stern

[57] ABSTRACT

A spring clip has a first holding portion having a longitudinal slit, a second holding portion in a confronting engageable relation with the first holding portion, and a side wall portion bridging the longitudinal side of the first holding portion and the second holding portion to thereby releasably hold objects to be held by reversing the reversing end portions. The slit extends longitudinally along the longitudinal side of the first holding portion and terminates at arc-shaped ends, and the first holding portion has a projecting portion extending toward the slit at the middle portion of the slit.

11 Claims, 5 Drawing Sheets

SPRING CLIP

BACKGROUND OF THE INVENTION

The present invention relates to a spring clip for holding sheets of paper or the like.

The inventor of the present invention suggested a very useful spring clip as disclosed in Japanese Utility Model Publication No. 3-7177/1991 (corresponding to U.S. Pat. No. 4,991,269 issued Feb. 12, 1991). This conventional spring clip will be explained presently with reference to FIG. 13.

In FIG. 13, the conventional spring clip has a first holding portion 1, a second holding portion 2 in a confronting engageable relation with the first holding portion 1 and a side wall portion 3 joining the first and second holding portions at their middle portion of the longer sides thereof. A slit 4 is formed in the first holding portion 1 so that it extends along the longer side of the first holding portion 1. The first holding portion 1 has a tension strip 5 between the longer side opposite to the side wall portion 3 and the slit 4, a pressing portion 6 at a center thereof and on the opposite side of the tension strip portion 5 relative to the slit 4, and reversing portions 7 at opposite ends.

When the conventional spring clip is used for holding sheets of paper, the sheets of paper are positioned between the spaced two holding portions 1 and 2 with the first holding portion 1 set as indicated by a phantom line A, and then the opposite ends of the reversing portions 7 are pushed by applying forces C and D thereto in the directions shown by arrows so that the reversing portions 7 are reversed or turned over to the state B indicated by a solid line. Thus, the sheets of paper are held in position by the holding portions 1 and 2.

When holding of the papers is required, a spot of the middle of the pressing portion 6 is pushed by applying thereto a force E in the direction of an arrow by manipulation, with the result that the reversing portions 7 are turned over back or returned from the state B to the state A.

The conventional spring clip described above is longitudinal and therefore it has a feature that the papers or the like is less covered up therewith so that less area of the papers is hidden by the clip. However, the inventor of the present invention has found that this conventional spring clip has a problem that, if the width of the pressing portion 6 is made smaller so as to develop the above-described feature more effectively, it causes substantial difficulty in the reversing action of the pressing portion 6 since the dimension F is reduced and consequently moment ($E \times F$) becomes smaller.

If, on the other hand, the width of the pressing portion 6 is increased by decreasing the width of the slit 4, it also causes difficulty in the reversing action of the pressing portion 6 due to an increase in rigidity and, in addition, stress concentration is produced in the edge-shaped spots of the opposite end parts of the slit. This causes a phenomenon that the spot are cracked by a stress which is produced repeatedly on the occasion of reversing actions.

Besides, a wave-shaped portion 8 extending outwardly is formed at the middle portion of the tension strip 5 and the wave-shaped portion 8 sometimes interferes a pressing action by a fingertip operation since a fingertip of a user touches accidentally the portion 8 at the time of pressing.

Furthermore, the width of the side wall portion 3 is set at the same medium dimension both on the side of the first holding portion 1 and on the side of the second holding portion so that the side wall portion 3 has the same width along its length as illustrated in FIG. 13, and this causes problems that the first holding portion 1 is not reversed smoothly and that a sufficient holding force is not obtained since the rigidity in the longitudinal direction of the second holding portion 2 is not large enough.

SUMMARY OF THE INVENTION

An object of the present invention is to provide an improved spring clip.

Another object of present invention is to eliminate the disadvantages found in the conventional spring clip by an inventive modification of the slit, the pressing portion, the tension strip and the side wall portions of the clip.

A further object of the present invention is to provide a new spring clip which can be actuated rapidly and smoothly by a simple manipulation without causing difficulty in reversing and returing actions.

Another object of the present invention is to provide a new spring clip which has a sufficient force for holding sheets of paper or the like and which can be used repeatedly without causing production of a crack on the reversing portions of the clip.

A further object of the present invention is to provide a new spring clip which can prevent a pressing portion from being reversed unintentionally even when a pressure is added to the clip in use.

The present invention provides a new spring clip comprising:

a first holding portion having a longitudinal slit, a tension strip at one side thereof and along said longitudinal slit, a pressing portion on a central portion thereof so that said tension strip is located in an opposed relation with said pressing portion relative to said slit, and reversing end portions at opposite ends thereof, a second holding portion in a confronting engageable relation with said first holding portion, and a side wall portion bridging the longitudinal sides of said first holding portion and second holding portion to hold the first and second holding portions together to thereby hold and release objects to be held by reversing said reversing end portions, wherein said slit extends longitudinally along the longitudinal side of said first holding portion and along said tension strip and terminates at arc-shaped ends, and said first holding portion has a projecting portion adjacent to said pressing portion so that said projecting portion extends towards said slit at the middle portion of said slit.

In an embodiment of the invention, the tension strip has a flat portion at a middle portion thereof so that the flat portion is located adjacent to the projecting portion to thereby facilitate the pressing action by manipulation at said pressing portion, and at least one wave-shaped portion on the other part of the flat portion.

In a preferred embodiment of the invention, the width of the side wall is set to be smaller on the side of the first holding portion and larger on the side of the second holding portion.

Since the opposite end parts of the slit are round or arc-shaped in the spring clip of the present invention, the rigidity of the pressing portion is so decreased as to facilitate the smooth reversing and, in addition, the opposite end portions can be prevented from being cracked. Since the formation of the central projecting portion enables the pressing of a spot to be further apart from the side wall portion, moment (E×F) increases and consequently the clip can be opended by a simple fingertip operation.

Since the middle part of the corrugated portion is not provided with a high wave portion or projection but shaped flat substantially, an operation of pressing the pressing portion is not interfered with.

The width of the side wall portion is set smaller on the side of the first holding portion and larger on the side of the second holding portion and, moreover, the elasticity of the the first holding portion is not impaired and this portion is reversed smoothly when the pressing portion is pushed. In addition, the rigidity in the longitudinal direction of the second holding portion is increased and consequently a sufficient holding force is secured on the occasion of holding papers or the like.

In another embodiment of the invention, a locking means is provided to the tension strip to prevent a relative movement between the pressing portion and the tension strip.

In a further embodiment of the invention, a projection extending upwardly to the position (height) of the pressing portion is provided.

PREFERRED EMBODIMENT OF THE INVENTION

Figure 13:
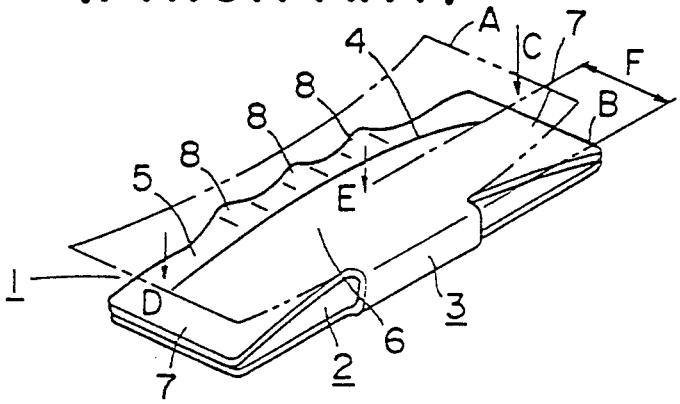
FIG. 13 (PRIOR ART)
FIG. 13 is a perspective view of an example of the conventional spring clip, suggested by the inventor of the present invention.

Referring to FIGS. 1–4, a spring clip of the present invention is, in a similar way as the conventional example shown in FIG. 13, made from an integral blank strip of a resilient material such as metal spring or plastics and formed by bending the strip. The spring clip has a first holding portion 1 of a lengthwise configuration, a second holding portion 2 of a similar lengthwise configuration in a confronting relation with the first holding portion 1 and a side wall portion 3 bridging the middle portions of the longitudinal sides of the first and second holding portions 1, 2 so that the first and second holding portions 1, 2 are joined together in a confronting engageable relation.

The first holding portion 1 has a slit 4 extending in the longitudinal direction thereof, a tension strip 5 with undulations on the opposite longitudinal side relative to the side wall portion and along one side of the slit 4 and has a pressing portion 6 on a central portion of the first holding portion 1. The first holding portion 1 has reversing end portions 7 near the opposite ends of the slit 4.

Figure 1:
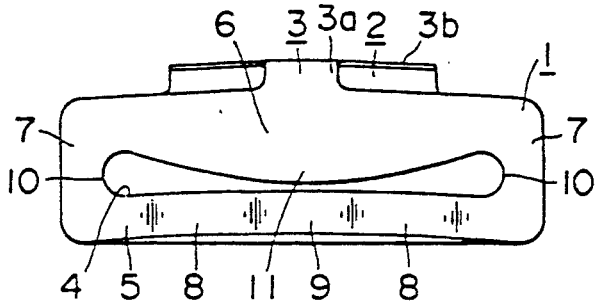
FIG. 1 is a plan view of a spring clip according to the present invention.

The slit 4 extends longitudinally as illustrated in FIG. 1 and terminates at round ends 10 which are arc-shaped. The pressing portion 6 is extended toward the middle of the tension strip 5 to form a projecting portion 11. In the present invention, the tension strip 5 has a flat portion 9 at its middle portion, and crests or wave-shaped portions 8 are formed on both sides of the flat portion 9. Thus, the middle portion of the tension strip 5 is flat and not extended upwardly at the position adjacent to the projecting portion 11 of the pressing portion 6.

As shown in FIG. 1, 2, 3 and 4 of the drawing, the width of the side wall portion 3 is set smaller on the side of the first holding portion 1, to form a smaller side wall **3*a* and large on the side of the second holding portion 2 to form a larger side wall 3*b***.

Figure 5:
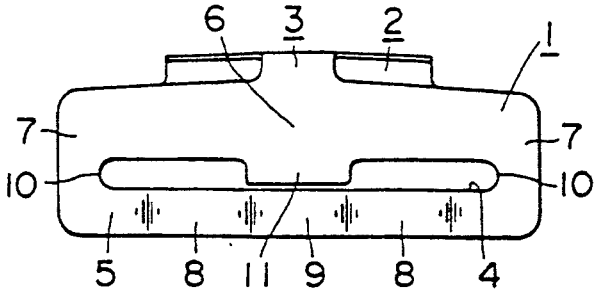
FIG. 5 is a plan view of the spring clip according to another embodiment of the invention.

In the embodiment of FIGS. 1–4, the projecting portion 11 forms a round shaped configuration so that one longitudinal side of the slit is curved as best shown in FIG. 1, but modification can be made as shown in FIG. 5. In FIG. 5, the projecting portion 11 of the pressing portion 6 is rectangular, and the opposite longitudinal side lines which form a tension strip 5 are substantially parallel to each other. The other structural features are substantially similar with those of the previous embodiment of FIGS. 1–4.

Figure 6:
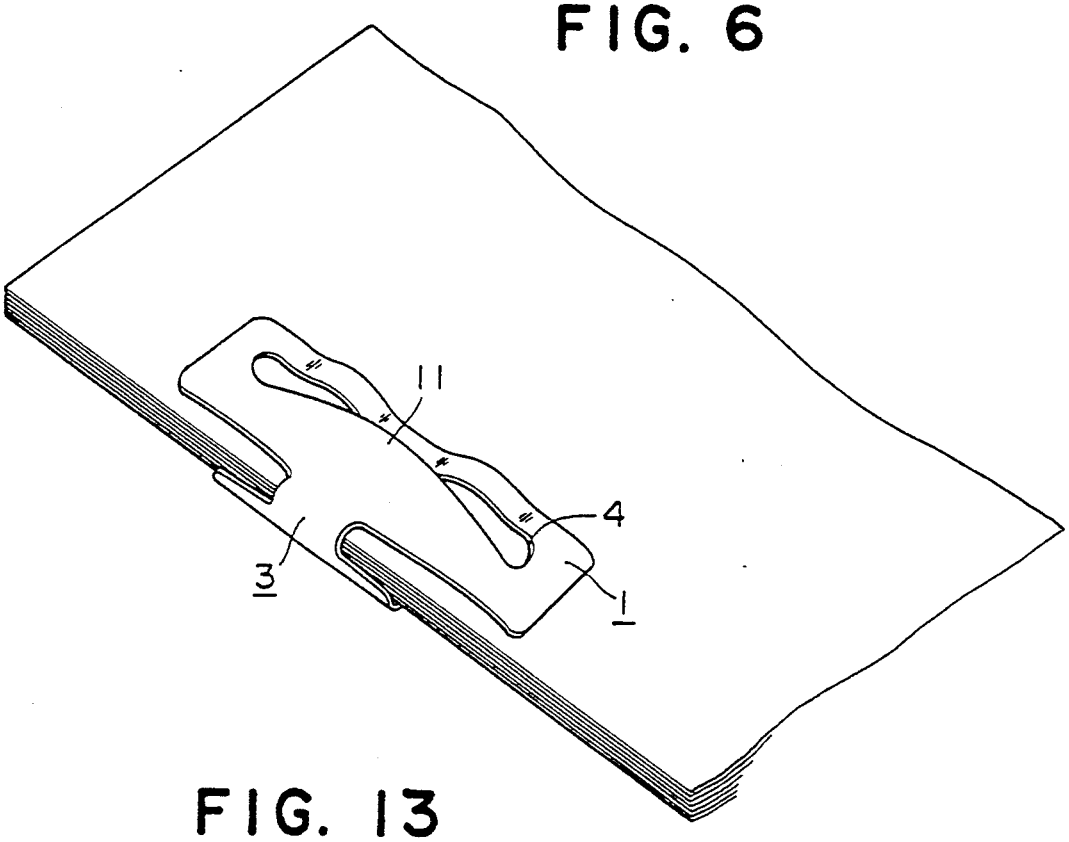
FIG. 6 is a perspective view of the spring clip shown in FIG. 1–4, showing the use of the spring clip for sheets of paper.

In either embodiment of the invention, the way of use of the spring clip is similar to that of the conventional spring clip shown and described with reference to FIG. 13. In use, predetermined sheets of paper are placed between the opened first and second holding portions 1, 2 of the spring clip in the state shown in FIG. 4, and the reversing end portions 7 are pressed toward the second holding portion 2 by a simple manipulation so that the reversing end portions 7 are returned to the closed position of FIG. 3, and thus the sheets of paper are clamped as shown in FIG. 6.

Figure 2:
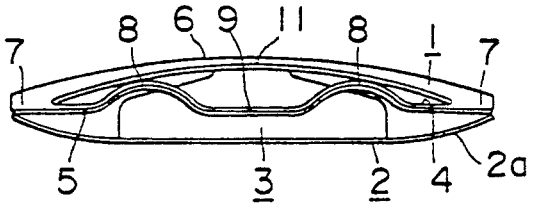
FIG. 2 is a front view of the spring clip shown in FIG. 1.
Figure 3:
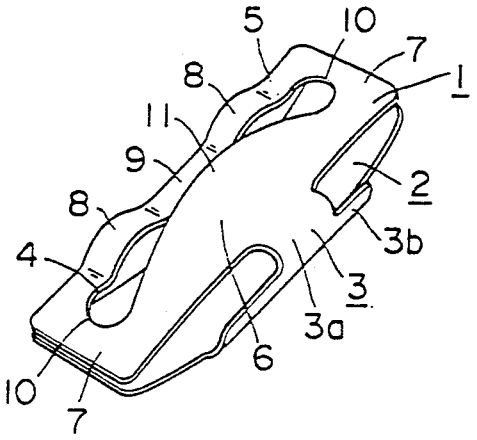
FIG. 3 is a perspective view of the spring clip in a closed, holding state.
Figure 4:
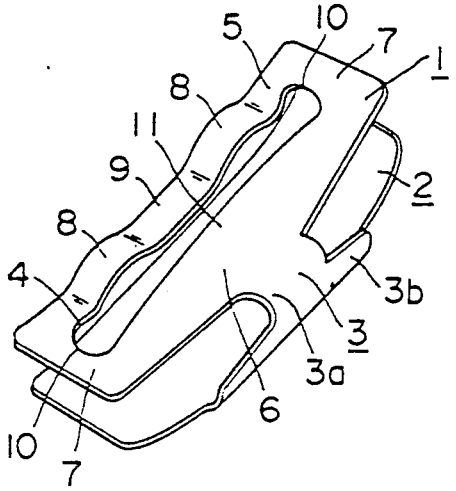
FIG. 4 is a perspective view of the spring clip in an opened, unholding state.

If the opposite ends of the second holding portion 2, the ends being, in a confronting abutment relation with the reversing end portions 7 of the first holding portion 1, are curved at **2*a* toward the first holding portion 1 as illustrated best in FIG. 2**, papers or the like can be held tight sufficiently.

Figure 7:
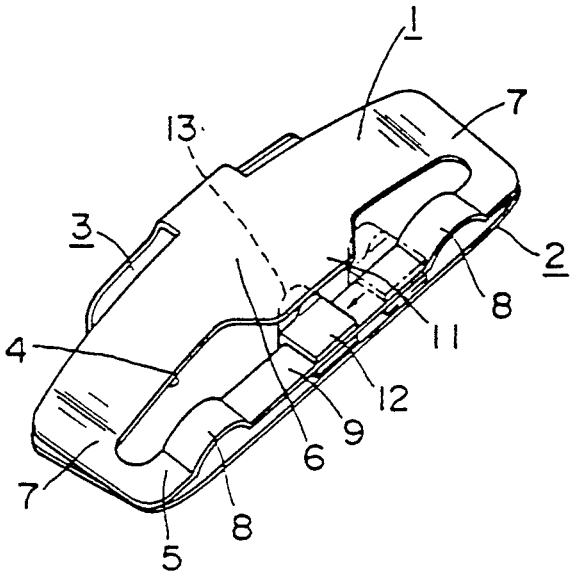
FIGS. 7 through 11 show additional embodiments of the invention, in which suitable device or element is provided for prevention of unintentional reversing operation of a pressing portion.

In FIG. 7 which shows a further embodiment of the invention, a locking member 12 having a locking portion 13 is provided for restricting a relative movement between the pressing portion 6 of the first holding portion 1 and the tension strip 5. The locking member 12 is slidingly moved in the direction shown by an arrow from an unlocked position shown by phantom lines to a position shown by solid lines so that the locking portion 13 is moved into a inner space of the pressing portion 6. When the locking portion 13 is moved into the lower space of the pressing portion 6, the pressing portion 6 is prevented from being reversed unintentionally in use and, therefore, ensures a stable gripping action of the clip even when a force is applied onto the pressing portion 6 during use.

Figure 8:
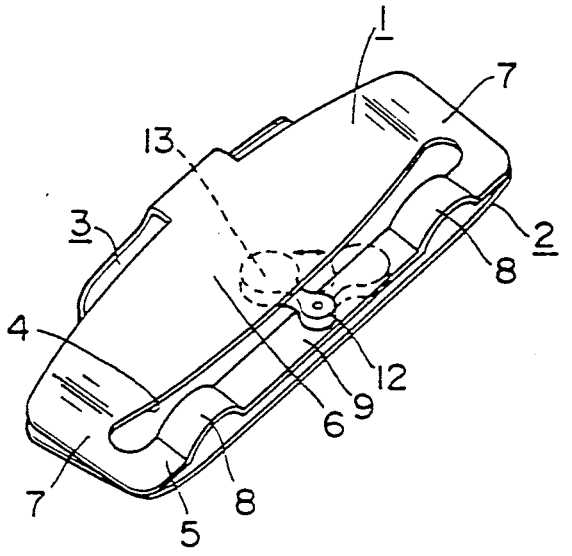
Figure 9:
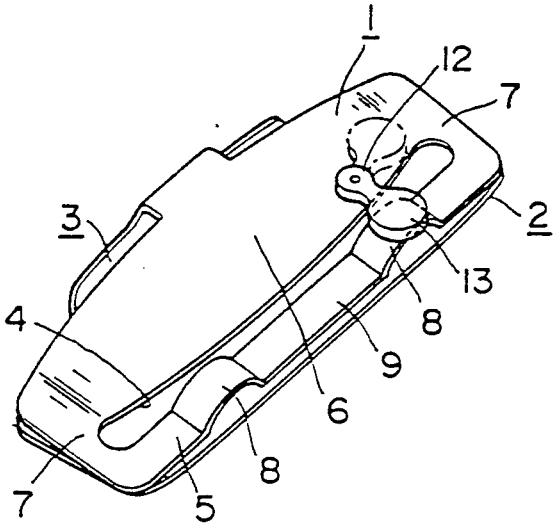

FIG. 8 shows a modification of the locking member 12 in the embodiment of FIG. 7. In the embodiment of FIG. 8, a rotary locking member 12 is rotatably disposed on the tension strip 5 so that the locking member 12 is rotated between a position shown by a solid line and a position shown by a phantom line to prevent a reversal movement of the pressing portion 6. The locking member 12 can be disposed on a portion of the pressing portion 6 so that the locking member 12 is moved to a position above the wave-shaped portion 8, as shown in FIG. 9.

Figure 10:
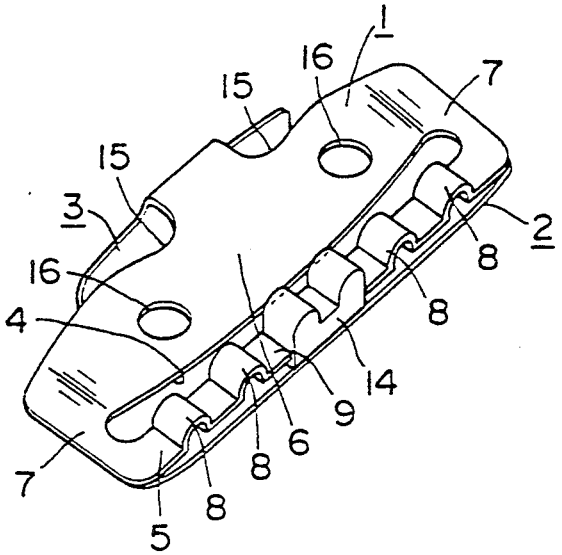
Figure 11:
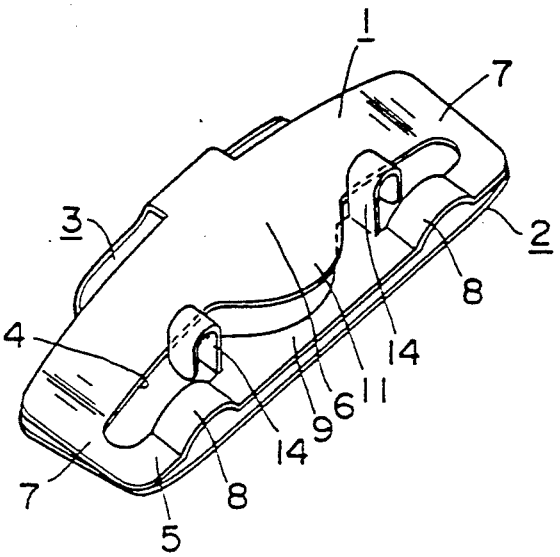

FIG. 10 shows a further embodiment of the invention, in which projections 14 are provided on the tension strip 5 in such a manner that the each of the projections 14 extended to a level substantially equal to the height of the pressing portion 6 when the first and second holding portions 1 and 2 are held in a closed position for use. The projections 14, which serve as the locking member 12 of the previous embodiments of FIGS. 7–9, can be formed unitarily relative to the clip structure as shown in FIG. 11. It will be appreciated that the projections 14 in the embodiments of FIGS. 10 and 11 can prevent the pressing portion from being reversed unintentionally even when a pressure is added onto the clip.

On the other hand, if it is desirable to provide an easy reversing action of the pressing portion 6 for the purpose of opening or releasing the closed position of the holding portions 1 and 2, recesses 15 and/or holes 16 can be provided at a suitable position of the pressing portion 6.

Figure 12:
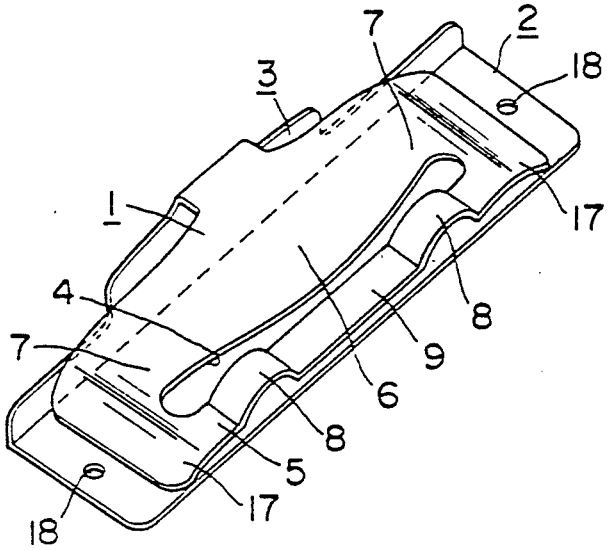
FIG. 12 is a perspective view of a spring clip according to another embodiment of the invention.

FIG. 12 shows a further embodiment of the invention, in which fixing holes are provided on opposite ends of the second holding portion 2 so that the clip is fixed on a binder such as those having a front cover and a back cover (not shown). In the clip structure of FIG. 12, the first holding portion has curved ends 17 which are curved toward the second holding portion 2.

The spring clip in the various embodiments of the present invention can be used also for a binder, a memorandum book or others by fitting it to a base board, although embodiments thereof are not illustrated, and furthermore it can be applied as various holders by providing it with an attaching means such as a magnet, a sticking agent, an adhesive, a suction disk, a hook, a screw, a rivet or the like.

According to the present invention, the reversing action of the holding portion is facilitated and the opposite end parts of this portion is prevented from being cracked, by shaping the opposite end parts of the slit is circular or arc shaped, while the clip can be opened with a relatively small force by providing the projecting portion to the pressing portion.

By forming the middle portion of the wave-shaped tension strip to be flat substantially, the middle portion can be prevented from interfering the pressing of the pressing part.

Since the width of the side wall portion is set to be smaller on the side of the first holding portion and larger on the side of the second holding portion, the first holding portion is reversed smoothly to improve an operability, and in addition, the rigidity in the longitudinal direction of the second holding portion is increased. Accordingly, a sufficient holding force can be secured on the occasion of holding papers or the like.

In the embodiment of FIGS. 7–11, the locking member (FIG. 7–9) and the projections (FIGS. 10 and 11) can prevent the pressing portion from being reversed unintentionally even when a pressure is added to the clip in use. Further, in the clip shown in FIG. 12, the inwardly curved ends of the first holding portion can improve applicability when a volume of papers to be held is increased.

What is claimed is:

1. A spring clip comprising:

a first holding portion having a longitudinal slit, a tension strip on one longitudinal side thereof and along said longitudinal slit, a pressing portion on a central portion thereof so that said tension strip is located in an opposed relation with said pressing portion relative to said slit, and reversing end portions at opposite end thereof, a second holding portion in a confronting engageable relation with said first holding portion, and a side wall portion bridging the longitudinal sides of said first holding portion and said second holding portion to thereby releasably hold objects to be held by reversing said reversing end portions, wherein said slit extends longitudinally along the longitudinal side of said first holding portion and along said tension strip and terminates at arc-shaped ends, and said first holding portion has a projecting portion adjacent to said pressing portion so that said projecting portion extends toward said slit at the middle portion of said slit.

2. The spring clip according to claim 1, wherein said tension strip has a substantially flat portion at a middle portion thereof so that said flat portion is located adjacent to said projecting portion to thereby facilitate a pressing action of said pressing portion by manipulation, and at least one wave-shaped portion on the other part of said flat portion.

3. The spring clip according to claim 1, wherein a width of said side wall portion is set to be smaller on the side of said first holding portion and larger on the side of said second holding portion.

4. The spring clip according to claim 1, further comprising a locking means, slidably disposed on said tension strip, for preventing a relative movement between said pressing portion and said tension strip.

5. The spring clip according to claim 1, further comprising a rotary locking means, on said tension strip, for preventing a relative movement between said pressing portion and said tension strip.

6. The spring clip according to claim 1, further comprising a rotary locking means for preventing a relative movement between said pressing portion and said tension strip, said rotary locking means being pivotally disposed on said pressing portion.

7. The spring clip according to claim 1, wherein said reversing end portions are curved at the ends thereof toward said second holding portion.

8. A spring clip comprising:

a first holding portion having a longitudinal slit, a tension strip on one longitudinal side thereof and along said longitudinal slit, a pressing portion on a central portion thereof so that said tension strip is located in an opposed relation with said pressing portion relative to said slit, and reversing end portions at opposite end thereof, a second holding portion in a confronting engageable relation with said first holding portion, and a side wall portion bridging the longitudinal side of said first holding portion and said second holding portion to thereby releasably hold objects to be held by reversing said reversing end portions, wherein said tension strip has a flat portion at a middle portion thereof to thereby facilitate a pressing action of said pressing portion by manipulation, and at least one wave-shaped portion on the other part of said flat portion.

9. A spring clip comprising:

a first holding portion having a longitudinal slit, a tension strip on one longitudinal side thereof and along said longitudinal slit, a pressing portion on a central portion thereof so that said tension strip is located in an opposed relation with said pressing portion relative to said slit, and reversing end portions at opposite end thereof, a second holding portion in a confronting engageable relation with said first holding portion, and a side wall portion bridging the longitudinal side of said first holding portion and said second holding portion to thereby releasably hold objects to be held by reversing said reversing end portions, wherein a width of said side wall portion is set to be smaller on the side of said first holding portion and larger on the side of said second holding portion.

10. A spring clip comprising:

a first holding portion having a longitudinal slit, a tension strip on one longitudinal side thereof and along said longitudinal slit, a pressing portion on a central portion thereof so that said tension strip is located in an opposed relation with said pressing portion relative to said slit, and reversing end portions at opposite end thereof, a second holding portion in a confronting engageable relation with said first holding portion, and a side wall portion bridging the longitudinal sides of said first holding portion and said second holding portion to thereby releasably hold objects to be held by reversing said reversing end portions, wherein projection means is provided to said tension strip, said projection means projecting as long as the height of said pressing portion.

11. A spring clip comprising:

a first holding portion having a longitudinal slit, a tension strip on one longitudinal side thereof and along said longitudinal slit, a pressing portion on a central portion thereof so that said tension strip is located in an opposed relation with said pressing portion relative to said slit, and reversing end portions at opposite end thereof, a second holding portion in a confronting engageable relation with said first holding portion, and a side wall portion bridging the longitudinal sides of said first holding portion and said second holding portion to thereby releasably hold objects to be held by reversing said reversing end portions, wherein a locking means is slidably disposed on said tension strip, for preventing a relative movement between said pressing portion and said tension strip.

* * * * *